US005180241A

United States Patent [19]

Gueret

[11] Patent Number: 5,180,241

[45] Date of Patent: Jan. 19, 1993

[54] APPLICATOR FOR A THIXOTROPIC PRODUCT, ESPECIALLY A MASCARA

[75] Inventor: Jean-Louis H. Gueret, Paris, France

[73] Assignee: L'Oreal, Paris, France

[21] Appl. No.: 781,909

[22] Filed: Oct. 24, 1991

[30] Foreign Application Priority Data

Nov. 8, 1990 [FR] France ..... 90 13850

[51] Int. Cl.[5] ..... A46B 11/00; A45D 40/00; A45D 40/26

[52] U.S. Cl. ..... 401/122; 401/4; 401/129

[58] Field of Search ..... 401/4, 122, 129; 132/218

[56] References Cited

U.S. PATENT DOCUMENTS 208,758 10/1878 Newton ..... 401/122 X
2,273,495 2/1942 Nelson ..... 401/122
4,175,574 11/1979 Zulberti ..... 401/122

FOREIGN PATENT DOCUMENTS 0099288 1/1984 European Pat. Off. .
0163323 12/1985 European Pat. Off. .
0202932 11/1986 European Pat. Off. .
0350535 1/1990 European Pat. Off. .
0365273 4/1990 European Pat. Off. .
2210812 10/1973 Fed. Rep. of Germany ..... 401/122
2722232 11/1978 Fed. Rep. of Germany ..... 401/122
1219912 5/1960 France .
2562773 10/1985 France .

*Primary Examiner*—Steven A. Bratlie

[57] ABSTRACT

A container for a thixotropic product includes a cap and a rod connected to the cap at one end thereof and having a brush at the opposite end which when the cap is attached to the container extends into the container through an orifice, the edge of which forms a wiping zone; an insertion channel is disposed at the entrance to the container and a helical spring is fixed on the interior of the insertion channel with the axis of the spring to substantially coinciding with the axis of the wiping zone with the spring being situated at least in the vicinity of a wiper with the inner diameter of the wiper being less than the largest diameter of the brush; when the brush passes into the interior of the spring while filled with the product, it is unloaded and reloaded as it passes over the turns of the spring which results in strirring of the product thereby breaking the thixotropy of the product.

17 Claims, 3 Drawing Sheets

APPLICATOR FOR A THIXOTROPIC PRODUCT, ESPECIALLY A MASCARA

BACKGROUND OF THE INVENTION

This invention relates to a device for the application of a thixotropic product with the aid of a brush. The invention relates in particular to a make-up assembly adapted in particular for making up the eyelashes by means of an eyelash booster product, still referred to as mascara. Also in the field of cosmetics, a thixotropic dye can be applied to the hair with the aid of a device of the same type.

A conventional mascara applicator comprises a mascara container and a movable cap which is adapted to close the container and forms a handle for the manipulation of a brush carried by the end of a rod integral with the cap. In the closed position of the container, the rod and the brush associated therewith are dipped into the container. When the rod is removed from the container, a certain quantity of mascara is taken up on the brush and can then be applied to the eyelashes. The brush generally penetrates into the interior of the container through an orifice of circular section which is formed in a wiper means disposed at the entrance to the container. The edge of the said orifice forms a wiper lip, the function of which is to exercise a wiping action on the bristles of the brush in order to remove the excess make-up product taken up by the brush from the interior of the container. The diameter of this orifice is less than the minimum diameter of the brush measured at the tip of the bristles, so that the edge of the said orifice can exercise its wiping action on the brush when the latter is removed from the container.

The brushes generally provided on these make-up assemblies often comprise relatively long bristles wound around a core formed by a twisted metal wire. The make-up product contained in the container is generally in the form of a thick or even pasty liquid. This results in irregular distribution of the make-up product taken up on the brush when it is removed from the mascara container, the product not being sufficiently fluid to cover the bristles of the brush in a regular manner. Although the make-up product is in fact thixotropic, the simple displacement of the bristles of the brush into the product when the brush is removed is not sufficient to reduce the viscosity of the said product to a significant extent. This irregular distribution of the product over the brush results in poor distribution of the product over the eyelashes, the mascara in practice being placed in pockets with no homogeneity, making it difficult and time-consuming to obtain a suitable uniform coating of mascara over the eyelashes.

SUMMARY OF THE INVENTION

This disadvantage can be obviated by this invention. To this end, an advantageously helical winding is disposed in the interior of the container substantially in the axis of the wiping zone, immediately upstream of the latter when the brush is removed, the turns of this winding being sufficiently far apart to allow for the free passage of the product between the interior and the exterior of the winding, and the inner diameter of the said winding being less than the largest diameter of the brush. In this manner, when the brush passes into the interior of the winding when the user removes the brush rod from the container, it is unloaded and reloaded as it moves in relation to the turns or the spaces between the turns respectively. At the same time, as a result of the fact that the bristles bend as they move in relation to a spiral wire, then open out suddenly as a result of their own rigidity, this ensures stirring of the product, the thixotropy of which it breaks. The product thus becomes more fluid and the brush is ultimately coated in a uniform manner as it is moved out of the container. After passage into the wiper means, the brush is then provided with a product the texture of which is uniform and fluid and which is well distributed, especially over the eyelashes, with no amalgamation.

Therefore, the object of this invention is the new industrial product consisting of a device for the application of a thixotropic product with the aid of a brush, especially a mascara for the eyelashes, comprising a container for the said thixotropic product, a movable cap joined to the container, a rod integral with the cap, disposed substantially along the axis thereof and projecting with respect to the said cap, and a brush comprising bristles carried by the end of the rod opposite the cap as an extension of the said rod, the brush penetrating into the interior of the container via a wiping zone, characterised in that a winding is disposed in the interior of the said container, at least a main part (P) of which comprises a plurality of non-contiguous turns, the axis of the said part (P) of the winding substantially coinciding with the axis of the wiping zone, the non-contiguous turns of the said part (P) of the winding internally defining a cylindrical space, the section of which is homothetic with respect to the largest section of the brush or its circumscribed circle in a homothetic ratio of less than 1, but sufficient to allow for the passage of the said brush through the part (P) of the winding.

It is stated explicitly that although the main part (P) of the winding must comprise a plurality of non-contiguous turns, it may still also comprise several contiguous turns, especially in its central zone.

In a first embodiment, in order to form the wiping zone, the device comprises a wiper means inserted into the neck of the container, the said means serving to fix the winding in the interior of the container. The through orifice of the wiper means may form a wiping zone substantially coaxial with the container, the section of the inner space defined by the part (P) of the winding being circular and coaxial with the wiping zone, the brush having a shape generated by rotation about its core.

The wiper means may consist of a sleeve fitting into the inlet of the container, defining the said insertion channel and being extended into the container by a cylindrical skirt, the inner free edge of which forms the wiping zone and around which the upper part of the winding engages, holding means being carried by the said skirt to allow for fixing of the said winding by means of its aforesaid upper part.

In a second embodiment, the wiping zone consists of a zone of the winding itself of small diameter. This zone is advantageously disposed between the main part (P) of the winding and a zone of the same winding serving to fix the latter in the container.

The winding may consist of a helical filiform element, especially a helical spring.

If the wiping zone is designed to allow the rod, when it is introduced into the container, to occupy an oblique position such that the brush sweeps the lateral wall of the said container, and has, in particular, sufficient suppleness, the winding is advantageously selected so that it is sufficiently deformable to accompany movements of this kind by the said rod.

An insertion channel may be provided for the brush rod, the said channel being disposed on the side of the wiping zone at which the container is not situated, the longitudinal axis of the said insertion channel substantially coinciding with the axis of the orifice through which the brush penetrates into the container, and its opening furthest from the wiping zone having a section greater than that of the brush in the free state.

The inner diameter of the part (P) of the winding is preferably greater than the diameter of the wiping zone. In addition, the part (P) of the winding may extend from the wiper means over a distance included between quarter and half the height of the container.

When the brush comprises a core and has a shape generated by rotation about this core, the inner diameter of the part (P) of the winding is advantageously included between approximately 0.9 times the largest outer diameter of the brush and approximately 2 times the diameter of the core of the brush.

The turns of the part (P) of the winding are advantageously spaced at such a distance from one another that the thixotropic product can pass freely between them and that the bristles of the brush can resume their normal position between two successive turns as the brush moves into the interior of the said winding when the user removes the brush rod from the container.

The spring may be made of a metal or a plastic material, which may or may not be flocked.

The brush advantageously consists of a central core made from a twisted metal wire confining a helical row of radial bristles The brush can preferably be inscribed in its entirety in a cylinder having an axis coinciding with that of the core, or even in an elongated truncated cone tapering towards its free end and having an axis coinciding with that of the core.

BRIEF DESCRIPTION OF THE DRAWINGS

The object of this invention will be more readily understood the following description of two embodiments, given purely by way of non-limiting examples and illustrated in the accompanying drawings, in which.

DETAILED DESCRIPTION OF THE INVENTION

Figure 1:
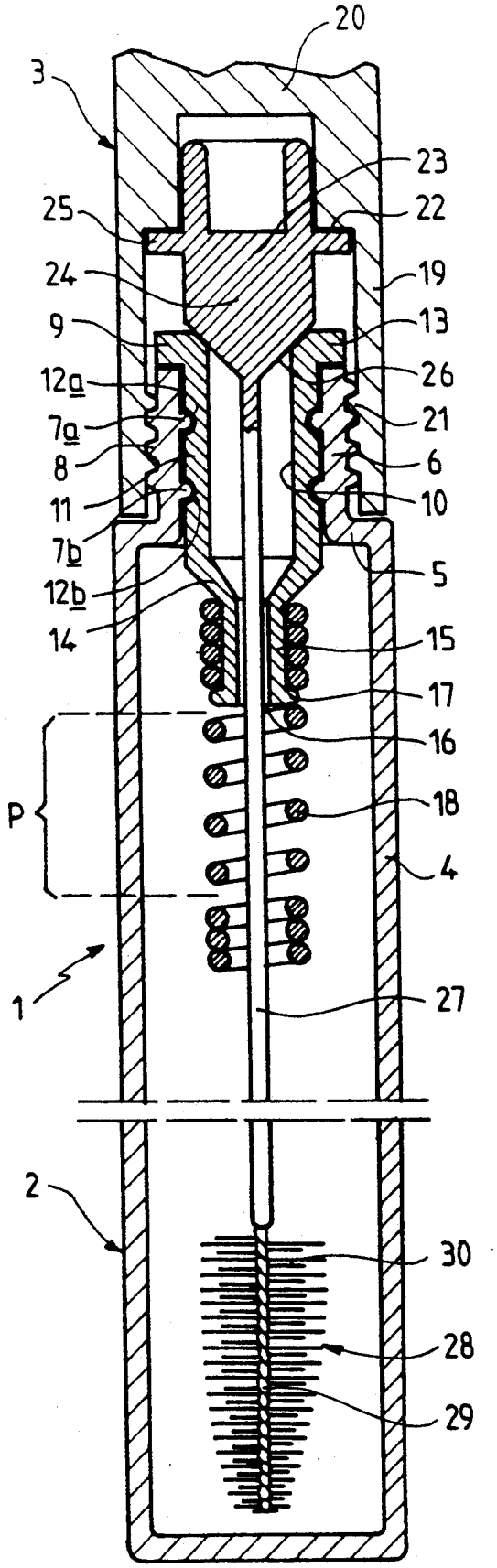
FIG. 1 is a partial axial section of an assembly for making up the eyelashes according to this invention, this assembly being closed by its closure cap ensuring sealing.
Figure 2:
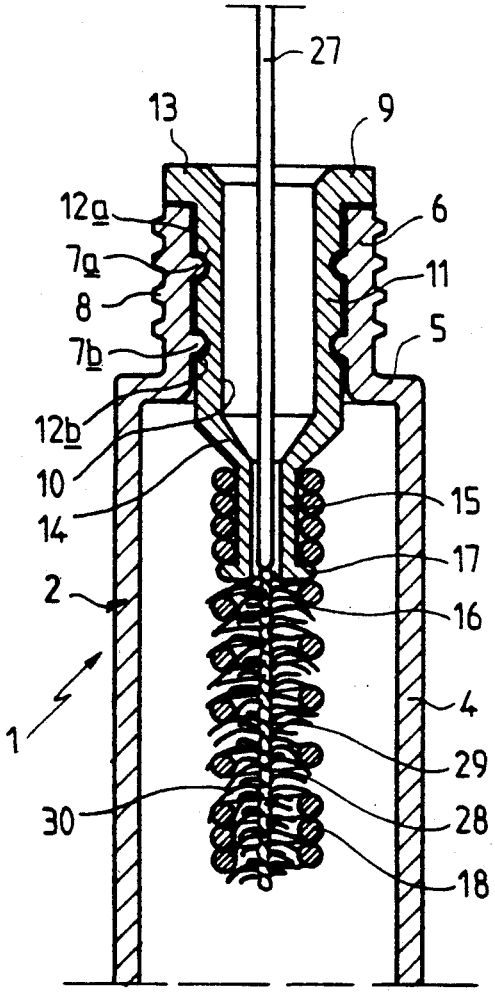
FIG. 2 is a partial view corresponding to FIG. 1, showing the upper part of the container with the associated wiper means, the rod being in the removed position.
Figure 3:
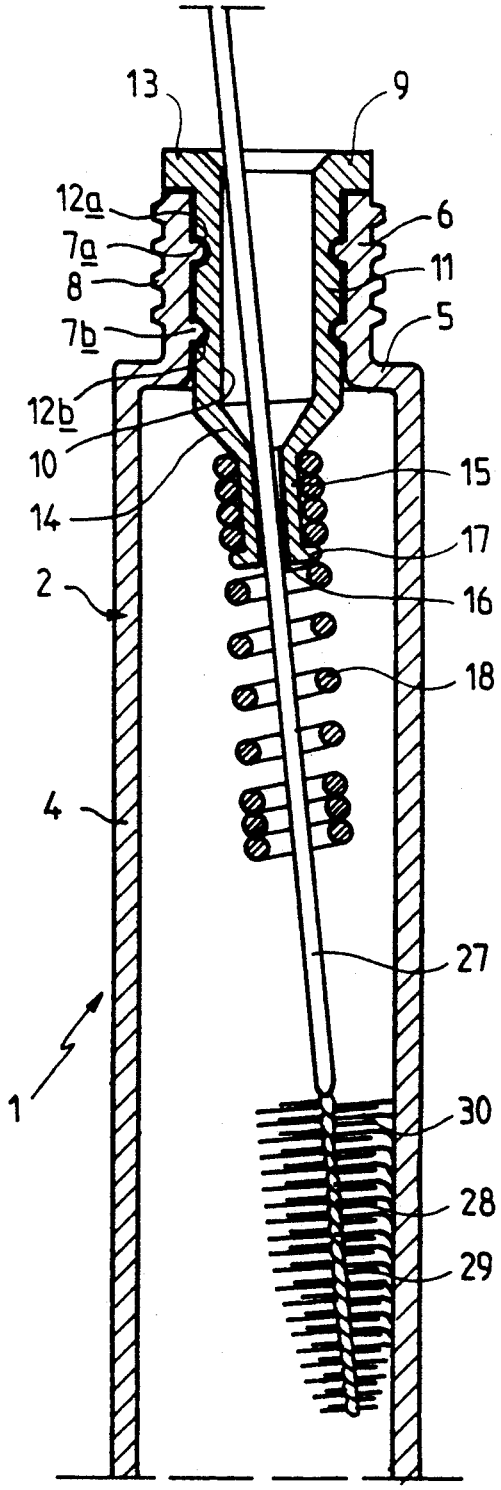
FIG. 3 is a partial view showing the container of the make-up assembly of FIG. 1, the rod being in an oblique position in order to take up the mascara which may be located against the lateral wall of the container.

Referring to FIGS. 1 to 3, it will be seen that a make-up assembly used for the application of mascara to the eyelashes is designated by the reference numeral 1. The assembly 1, as can be seen in FIG. 1 in the closed position, is in the form of a small cylindrical stick, the lower part of which consists of a cylindrical mascara container 2 and the upper part of which consists of a cap 3 which is also cylindrical. In the closed position, the cylindrical wall of the cap 3 forms a continuation of the wall of the container 2.

In the vicinity of its upper edge, the lateral cylindrical wall 4 of the container 2 has an annular shoulder 5 directed towards the interior, separating the actual body of the container 2 from the neck 6 thereof. Two peripheral retaining rings *7a, 7b* are provided at a distance from one another on the inner wall of the latter, the function of which is indicated hereinafter. Moreover, the neck 6 has an external thread 8, the function of which is also indicated hereinafter.

A semi-rigid wiper means 9 is fixed in the inlet of the container 2, and simultaneously defines an insertion channel 10 for a brush rod which will be described hereinafter.

The wiper means 9 consists of a cylindrical sleeve 11 adapted to be positioned in the inlet of the neck 6 and to be fixed thereto. To this end, its wall comprises two annular grooves 12*a*, 12*b* adapted to cooperate with the peripheral retaining rings *7a, 7b* respectively of the container 2. At one of its ends, the cylindrical sleeve 11 is bent over at a right angle towards the exterior in order to form a collar 13 adapted to rest on the free edge of the neck 6 when the wiper means 9 is in the assembled position. At its opposite end, which must be situated in the interior of the container 2 in the assembled position, the sleeve 11 tapers along a truncated portion 14 in order to be extended towards the container by a cylindrical skirt 15. The free edge of the inner wall of the skirt 15 forms the wiping zone 16 of the brush of the assembly 1.

The skirt 15 comprises on its free outer edge an external peripheral flange 17 serving as a means of fixing a metal helical spring 18 to the wiper means 9. In the assembled position, the spring 18 is disposed in such a manner that its axis is situated substantially as an extension of the axis of the wiping zone 16. The turns of the spring 18 are closer together in each of the end zones of the said spring 18. The spring surrounds the skirt 15 by its upper end zone having turns closer together, the lower turn of this zone coming to rest against the flange 17. The main part (P) of the spring 18, in which the turns are non-contiguous, is situated between the two end zones of the said spring. The part (P) of the spring 18 has a length covering substantially a third of the height of the container 2.

The cap 3 has a cylindrical lateral wall 19 connected to a base 20 and provided with an internal thread 21 adapted to cooperate with the external thread 8 carried by the neck 6. In addition, the inner surface of the wall 19 comprises an annular recess 22, so that the said wall 19 is thicker in the region close to the base 20.

A capsule 23 is forced into the inlet of the said cap 3. This capsule 23 comprises a main body 24 of generally cylindrical shape, by means of which the capsule 23 is inserted into the zone of the base 20 of the cap 3. The cylindrical body 24 comprises a lateral collar 25 abutting against the annular recess 22 in the assembled position. At the opposite end of the base 20, the body 24 of the capsule 23 tapers along a truncated zone 26 adapted to come to rest against the upper inner edge of the wiper means 9 in the closed position of the assembly 2 in order to ensure sealing.

A rod 27 formed in one piece with the capsule 23 is disposed in the axis of the said capsule 23. This rod 27 projects to the exterior of the cap 3 and ends in a brush 28 having a cylindrical casing which, in the closed position of the make-up assembly 1, is dipped into the container 2, the end of the brush 28 opposite the end connected to the rod 27 in this position reaching the vicinity of the base of the container 2. The casing of the brush 28 has a shape generated by rotation about the rod 27. It will be seen that the protective cap 3 forms a handle for easy manipulation of the brush 28. The section of the rod 27 is slightly less than the section of the wiping zone 16.

The brush 28 comprises a core 29 which is disposed in the axis of the rod 27. The core 29 is formed by doubling over a metal wire, then twisting the wire doubled in this manner, so as to build up a helical row of radial bristles 30 around the core 29. The minimum diameter of the brush 28 at rest, measured at the tip of the bristles 30, is greater than the inner diameter of the wiping zone 16 and also greater than the inner diameter of the part (P) of the helical spring 18.

The assembly of this make-up assembly 1 is extremely simple. The helical spring 18 is made integral with the wiper means 9, as indicated hereinbefore, and the assembly is inserted into the neck 6 of the container 2 until the retaining rings 7*a*, 7*b* penetrate into the respective grooves 12*a*, 12*b*, the collar 13 then coming to rest against the upper edge of the container 2. The make-up product is then introduced, if this has not been done already, then the assembly is closed by the cap 3 with the associated brush rod 27.

This make-up assembly 1 operates as follows.

When the brush 28 is removed from the container 2, it arrives in the position shown in FIG. 2 at the part (P) of the spring 18, where its bristles 30 bend and relax successively, traversing the turns of the main part of the spring 18, which are sufficiently far apart for the thixotropic mascara product to be able to penetrate into and reemerge from the turns as a result of the negative pressure and the wiping of the bristles as the brush passes, the said brush then remaining charged with a fluid product until it arrives in the wiping zone 16. The thixotropy of the mascara is broken as the brush 28 is displaced towards the outlet of the container as a result of the agitation thereof as the bristles 30 pass over the turns.

As the wiper means 9 is made of a semi-rigid material, it is moreover possible, when desired, to reach the lateral wall 4 of of the container 2 with the brush 28, according to a position as shown in FIG. 3.

Figure 4:
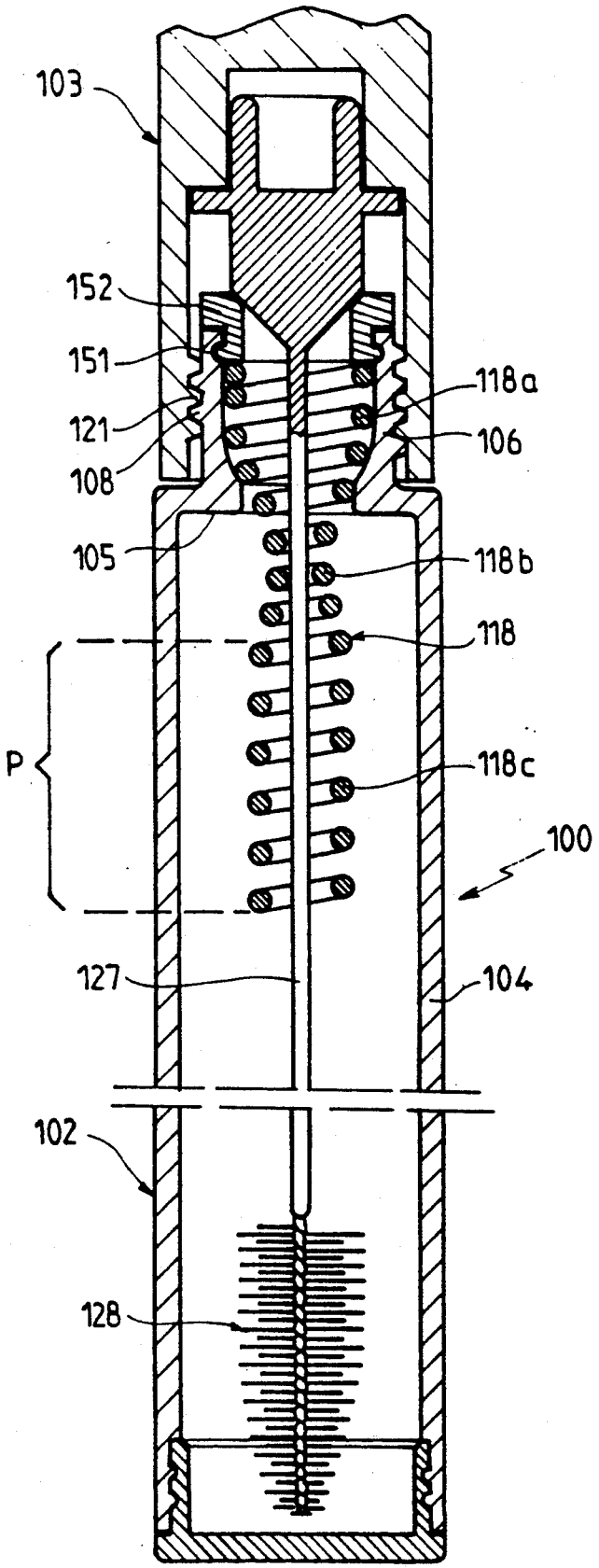
FIG. 4 is a partial axial section (analogous to that of FIG. 1) of an assembly for making up the eyelashes using the variant embodiment in which the wiper means consists of an extension of the winding having non-contiguous turns traversed by the brush.

Referring now to FIG. 4, it will be seen that a make-up assembly used for the application of mascara to the eyelashes is designated by the reference numeral 100, this assembly using the variant according to which the wiper means consists of an extension of the winding having non-contiguous turns, which may be traversed by the brush 128 of the device.

The assembly 100 is shown in the closed position in FIG. 1. It is in the form of a small cylindrical stick, the lower part of which consists of a cylindrical container 102 containing mascara and the upper part of which consists of a cap 103 which is also cylindrical. In the closed position, the cylindrical wall of the cap 103 forms a continuation of the wall of the container 102.

In the vicinity of its upper edge, the lateral cylindrical wall 104 of the container 102 has an annular shoulder 105 directed towards the interior, separating the actual body of the container 102 from the neck 106 thereof. The neck 106 carries an external thread 108 adapted to cooperate with an internal thread 121 carried by the cap 103. An annular snap groove 151 which cooperates with a snap flange carried by a stop ring 152 is provided in the upper part of the neck 106.

The design of the cap 103 is absolutely identical to that of the cap 3 described hereinbefore and will therefore not be repeated in detail. The cap 103 carries a rod 127 provided at its base with the brush 128, the design of which is identical to that of the brush 28 described hereinbefore.

A helical spring 118 made of plastic material is disposed in the interior of the neck 106. This spring has three functional zones connected to one another by intermediate zones. The first functional zone 118*a* has a cylindrical external shape and is disposed in the interior of the neck 106, its outer diameter substantially corresponding to the inner diameter of the neck 106. The second functional zone 118*b* also has a cylindrical shape, but the outer diameter of this zone is much smaller than that of the zone 118*a* and its inner diameter is only slightly greater than the diameter of the rod 127. The third functional zone 118*c* is also cylindrical and its outer diameter is somewhere between that of the zones 118*a* and 118*b*, the said outer diameter being equal to the diameter of the central passage defined by the annular shoulder 105. The three functional zones defined hereinabove are connected together by conical zones. The turns of the spring 118 may or may not be contiguous in the zones 118*a* and 118*b* and in the intermediate zones. They are preferably closer together in the main zone 118*b*. In the zone 118*c*, which forms the main part (P) of the winding, the turns of the spring 118 are non-contiguous.

The spring 118 is placed in the container 102 starting from the neck 106, and the intermediate zone between the functional zones 118*a* and 118*b* comes to rest against the upper face of the annular shoulder 105. The stop ring 152 is then snapped into place at the upper part of the neck 106 in order to hold the spring 118 in position in the container 102.

It will be seen that, in this embodiment, the functional zone 118*c* of the spring 118 plays exactly the same role played by the cylindrical part of the spring 18 having non-contiguous turns in the embodiment of FIGS. 1 to 3. The functional zone 118*c* has a length covering substantially a third of the height of the container 102. The passage of the brush 128 through this zone when it is removed from the container 102 therefore results in breakage of the thixotropy of the mascara.

The wiping action is effected in this variant without having to provide a wiper means like the wiper means 9 shown and described for the variant embodiment of FIGS. 1 to 3. In this case, the wiper means is formed by the functional zone 118*b* of the spring 118, this zone having an inner diameter substantially corresponding to that of the cylindrical skirt 15 of the wiper means 9 described in the first variant. It will therefore be seen that, in this embodiment, the wiping action is effected using the spring which, in another of its functional zones, effects breakage of the thixotropy of the mascara and which, via its third functional zone, ensures that it is itself fixed in the interior of the container 102.

It will be clear that the embodiments described hereinabove are in no way limiting and could be modified in any desired manner without thereby going beyond the scope of this invention.

I claim:

1. Device for the application of a thixotropic product with the aid of a brush, especially a mascara for the eyelashes, comprising a container (2, 102) for the said thixotropic product, a movable cap (3, 103) joined to the container (2, 02), a rod (27, 127) integral with the cap (3, 103), disposed substantially along the axis thereof and projecting with respect to the said cap (3, 103), and a brush (28, 128) comprising bristles carried by the end of the rod (27, 127) opposite the cap (3, 103) as an extension of the said rod (27, 127), the brush (28, 128) penetrating into the interior of the container (2, 102) via a wiping zone, characterised in that a winding (18, 118) is disposed in the interior of the said container (2, 102), at least a main part (P) of which comprises a plurality of non-contiguous turns, the axis of the said part (P) of the winding substantially coinciding with the axis of the wiping zone, the non-contiguous turns of the said part (P) of the winding internally defining a cylindrical space, the section of which is homothetic with respect to the largest section of the brush (28, 128) in a homothetic ratio of less than 1, but sufficient to allow for the passage of the said brush through the part (P) of the winding (18, 118).

2. Device according to claim 1, characterised in that the part (P) of the winding coil comprises a plurality of contiguous turns in its central zone.

3. Device according to one of claims 1 and 2, characterised in that, in order to form the wiping zone, it comprises a wiper means (9) inserted into the neck (6) of the container (2), the said means serving to fix the winding (18) in the interior of the container (2).

4. Device according to claim 3, characterised in that the through orifice of the wiper means (9) forms a wiping zone (16) substantially coaxial with the container (2), the section of the inner space defined by the part (P) of the winding (18) being circular and coaxial with the wiping zone (16), the brush (28) having a shape generated by rotation about its core (29).

5. Device according to claim 3, characterised in that the wiper means (9) comprises a sleeve (11) fitting into the inlet of the container (2), defining an insertion channel (10) and being extended into the container (2) by a cylindrical skirt (15), the inner free edge of which forms the wiping zone (16) and around which the upper part of the winding engages (18), holding means (17) being carried by the said skirt (15) to allow for fixing of the said winding (18).

6. Device according to claim 1, characterised in that the wiping zone comprises a functional zone (118*b*) of the winding (118) of small diameter.

7. Device according to claim 6, characterised in that the functional zone (118*b*) of the winding, which forms the wiping zone, is disposed between the functional zone (118*c*) forming the main part (P) of the said winding and a functional zone (118*a*) serving to fix the winding in the container (102).

8. Device according to claim 1, characterised in that the inner diameter of the part (P) of the winding (18, 118) is greater than the diameter of the wiping zone.

9. Device according to claim 1, characterised in that the winding (18, 118) comprises a helical filiform element.

10. Device according to claim 9, characterised in that the winding (18, 118) is a helical spring.

11. Device according to one of claims 1 or 10, in which said winding is deformable to allow said brush to sweep an internal lateral wall of the container.

12. Device according to claim 1, wherein an insertion channel is provided and said wiping zone has a side within said container and an opposite side facing outwardly of said container and said insertion channel is disposed on said opposite side of said wiping zone, said insertion channel having a longitudinal axis substantially coinciding with the axis of the orifice through which the brush penetrates into the container and having an opening farthest from the wiping zone having a section greater than that of the brush.

13. Device according to claim 1, characterised in that the part (P) of the winding (18, 118) extends from the wiping zone over a distance included between quarter and half the height of the container (2, 102).

14. Device according to one claim 1, characterised in that the brush (28, 128) comprises a core which carries, in a substantially radial arrangement, bristles distributed in order to form a brush having a shape generated by rotation about the said core, the inner diameter of the part (P) of the winding (18, 118) being included between approximately 0.9 times the largest outer diameter of the brush (28, 128) and approximately 2 times the diameter of the core of the said brush.

15. Device according to one claim 1, characterised in that the turns of the part (P) of the winding (18, 118) are spaced at such a distance from one another that the thixotropic product can pass freely between them and that the bristles of the brush (28, 128) can resume their normal position between two successive turns as the brush (28, 128) moves into the interior of the said winding (18, 118).

16. Device according to claim 1, characterised in that the winding (18, 118) is made of a metal or a plastic material.

17. Device according to claim 16, wherein said material is flocked.

* * * * *